US006139368A

United States Patent [19]

Bogese, II

[11] Patent Number: 6,139,368

[45] Date of Patent: Oct. 31, 2000

[54] FILTERED MODULAR CONNECTOR

[75] Inventor: Stephen B. Bogese, II, Roanoke, Va.

[73] Assignee: Thomas & Betts International, Inc., Sparks, Nev.

[21] Appl. No.: 09/217,359

[22] Filed: Dec. 21, 1998

[51] Int. Cl.[7] ..... H01R 13/66

[52] U.S. Cl. ..... 439/620; 439/676

[58] Field of Search ..... 439/620, 607, 439/610; 333/181, 185

[56] References Cited

U.S. PATENT DOCUMENTS

| | | | |
|---|---|---|---|
| 3,835,445 | 9/1974 | Hardesty . | |
| 4,210,376 | 7/1980 | Hughes et al. . | |
| 4,269,467 | 5/1981 | Hughes . | |
| 4,296,991 | 10/1981 | Hughes et al. . | |
| 4,428,636 | 1/1984 | Kam et al. . | |
| 4,457,570 | 7/1984 | Bogese, II . | |
| 4,501,464 | 2/1985 | Bogese, II . | |
| 4,589,720 | 5/1986 | Aujla et al. | 339/147 |
| 4,717,217 | 1/1988 | Bogese, II . | |
| 5,139,442 | 8/1992 | Sakamoto et al. . | |
| 5,195,911 | 3/1993 | Murphy . | |
| 5,207,597 | 5/1993 | Kline et al. . | |
| 5,224,868 | 7/1993 | Tseng . | |
| 5,312,273 | 5/1994 | Andre et al. . | |
| 5,378,172 | 1/1995 | Roberts . | |
| 5,395,268 | 3/1995 | Okada . | |
| 5,397,250 | 3/1995 | Briones | 439/620 |
| 5,431,584 | 7/1995 | Ferry | 439/620 |
| 5,478,261 | 12/1995 | Bogese, II . | |
| 5,647,765 | 7/1997 | Haas et al. . | |
| 5,647,767 | 7/1997 | Scheer et al. . | |
| 5,679,013 | 10/1997 | Matsunaga et al. . | |
| 5,940,959 | 8/1999 | Caveney et al. | 439/620 |

*Primary Examiner*—Gary F. Paumen
*Assistant Examiner*—Phuongchi Nguyen
*Attorney, Agent, or Firm*—Hoffmann & Baron, LLP

[57] ABSTRACT

A modular jack having means for filtering the signals on the conductors of the jack as a way of reducing noise. The filtering means preferably comprises one or more capacitor modules adapted to be in electrical contact with the conductors of the jack. More particularly, the capacitor modules may each comprise substrates having conductive traces arranged thereon, the size and location of the traces being selected to provide the desired capacitances. Portions of the traces are placed in electrical contact with the intermediate portions of the conductors in the jack.

32 Claims, 10 Drawing Sheets

FILTERED MODULAR CONNECTOR

BACKGROUND OF THE INVENTION

I. Field of the Invention

The present invention relates to electrical connectors and, more particularly, is directed towards a modular connector or jack which is designed to couple a modular plug to a printed circuit board.

II. Description of the Related Art

Modular jacks for coupling modular plugs to printed circuit boards are well known in the art. See, for example, my prior U.S. Pat. Nos. 4,457,570; 4,501,464; and 4,717,217. The modular jacks described in my earlier patents are all characterized by the provision of a dielectric housing and a plurality of side-by-side conductors located within the housing. Each of the conductors includes a spring contact portion at the front of the housing for mating with a contact terminal of a mating modular plug, an end portion at the rear of the housing for connection to a printed circuit board, and an intermediate portion disposed between the spring contact portion and the end portion. The conductors are further characterized in that the spacing between adjacent spring contact portions is less than the spacing between adjacent end portions. For example, the spacing between adjacent spring contact portions is preferably 0.040" in order to properly mate with the contact terminals of a modular plug. Further, the spacing at the end portions is generally 0.050" in order to mate with standard grid spacing for a printed circuit board (PCB). The fact that the spring contact portions at the front end of the connector are spaced differently from the end portions at the rear end of the connector shall be referred to hereinafter as differential spacing.

In addition, the spacing at the rear of the housing where the end portions are located are formed in two rows which are themselves spaced apart a distance equal to twice the adjacent conductor spacing. This pattern of the end portions forms what will be referred to hereinafter as an alternating, staggered array.

Another characteristic of my above-noted prior U.S. patents is that the spring contact portions of the conductors enter the plug-receiving cavity from the rear towards the front thereof. A number of other modular jacks have been designed whereby the spring contact portions enter the plug-receiving-cavity from the front and are angled towards the rear of the cavity. See, for example, U.S. Pat. Nos. 4,210,376; 4,269,467 and 4,296,991. The conductors in these latter jacks also exhibit differential spacing, and the end portions, which are coupled to the PCB, are also arranged in an alternating, staggered array.

Recently, modular jacks have developed noise problems. These generally stem from unwanted harmonics or noise from an adjacent line. Such noise could also come from radiation in the air or on the cable, or the noise could be internally coupled from the outputs of different devices. The tiny chips with which the modular jacks are utilized to run at very high frequencies, which also generates noise in the cabinet.

The danger of noise, of course, is that it could produce a variation in the amplitude of the signals on the lines. This could, in turn, result in a false positive, or could undesirably cancel another signal.

It has therefore recently become apparent that some type of filtering mechanism is necessary for use with these modular jacks for eliminating or greatly reducing this unwanted noise. It is towards this end that the present invention is advanced.

OBJECTS AND SUMMARY OF THE INVENTION

It is therefore a primary object of the present invention to provide a modular jack which includes means for reducing the noise on the conductors of the jack.

Another object of the present invention is to provide a modular jack with filtering means that is located entirely within the housing of the modular jack.

A further object of the present invention is to provide a filtered modular jack which can provide a wide range of selected capacitance for filtering the signals on the conductors of the jack.

An additional object of the present invention is to provide means for filtering the signals in a modular jack which may be utilized with any of the wide variety of modular jacks currently on the market.

A still further object of the present invention is to provide a modular jack for coupling a modular plug to a printed circuit board with means fixably coupled to the conductors of the jack for filtering the signals appearing on the conductors.

The foregoing and other objects are achieved in accordance with one aspect of the present invention through the provision of a modular jack for electrically connecting a modular plug to a printed circuit board. The jack is of the having a dielectric housing within which are positioned a plurality of side-by-side conductors. Each of the conductors includes a spring contact portion adapted to mate with a contact member in the modular plug, an end portion adapted to be connected to the printed circuit board, and an intermediate portion located between the spring contact portion and the end portion. The end portions are arranged in an alternating, staggered array. The modular jack of the invention comprises means located in the housing in electrical contact with the—intermediate portions of the conductors for providing a capacitor in series with each of the conductors.

More particularly, the means for providing a capacitor in series with each of the conductors comprises a first capacitor module means for providing a first set of capacitors in electrical contact with a first set of intermediate portions of the conductors, and a second capacitor module means for providing a second set of capacitors in electrical contact with a second set of intermediate portions of the conductors.

In accordance with other aspects of the present invention, the first and second capacitor module means comprise first and second substantially planar substrates, respectively. The first and second substantially planar substrates are preferably positioned in the housing substantially parallel with one another. In one embodiment, the first and second substrates are located on opposite sides of the intermediate portions of the conductors, while in an alternate embodiment, the first and second substrates are located on the same side as the intermediate portions of the conductors.

Alternately, the first and second substrates may be positioned in the housing substantially co-planar with one another.

In accordance with more specific aspects of the present invention, each of the first and second substrates preferably comprises a front side, and a back side which is parallel with and spaced from the front side. The front side preferably includes a plurality of conductive traces formed thereon, while the back side has a ground plane formed thereon. More specifically, each conductive=m comprises a capacitor, and is substantially U-shaped. The U-shaped capacitors have two legs, one of which is electrically connected to an intermediate portion of one of the conductors of the modular jack. The front sides of the first and second substrates are preferably closer to each other than their respective back sides. There further may be provided ferrite rod means connected to the conductive traces for providing further filtering.

In accordance with another aspect of the present invention, the first substrate further includes a plurality of fingers projecting from one edge thereof. One of the legs of each of the U-shaped capacitors on the front side of the first substrate preferably extends along the fingers thereof and includes a roll-over portion extending over the edge of the respective finger. In addition, one of the two legs on the front side of the second substrate preferably includes a roll-over portion extending over the edge of the second substrate. In this embodiment, a third substrate is preferably located between the first and second substrates for insulating each from the other in accordance with another aspect of the present invention, the first and second capacitor module means may comprise first and second complimentary substrates, respectively. The first and second complimentary substrates are preferably positioned on opposite sides of the intermediate portions of the conductors. Each of the first and second substrates comprises a front side, and a back side which is parallel with and spaced from the front side, the front side having a plurality of conductive formed thereon, the back side having a ground plane formed thereon.

In accordance with another aspect of this embodiment, the first and second complimentary substrates each include a plurality of fingers extending from one edge thereof, the fingers from the first and second complimentary substrates adapted to interfit with each other. The intermediate portions of the conductors are positioned adjacent the tips of the fingers of the first and second complimentary substrates.

In accordance with more specific aspects of the present invention, the front side of the first substrate includes a first set of conductive traces which extend along the fingers of the first substrate and which include first roll-over portions that extend over the front face of the fingers. In addition, the front side of the second complimentary substrate includes a second set of conductive traces which extend along the fingers of the second substrate and which include second roll-over portions that extend over the front face of the fingers. In addition, the front side of the first complimentary substrate further preferably includes a third set of conductive traces which extend parallel to and between the first set of conductive traces, the third set of traces preferably including third roll-over portions that extend over the edge of the spaces between the fingers of the first substrate.

In accordance with more specific aspects of the latter embodiment, the first set of conductive comprises the first set of capacitors, while the second and third set of conductive trace comprises the second set of capacitors. The first rollover portions contact the first set of intermediate portions of the conductors, while the second and third roll-over portions contact the second set of intermediate portions of the conductors. In this embodiment, means are further preferably provided for electrically connecting the ground planes on the back sides of the first and second complimentary substrates to each other.

BRIEF DESCRIPTION OF THE DRAWINGS

The foregoing and other objects, aspects and features of the present invention will be more fully appreciated as the same becomes better understood when considered in connection with the following detailed description of the present invention viewed in conjunction with the accompanying drawings, in which.

DETAILED DESCRIPTION OF THE PREFERRED EMBODIMENTS

Figure 1:
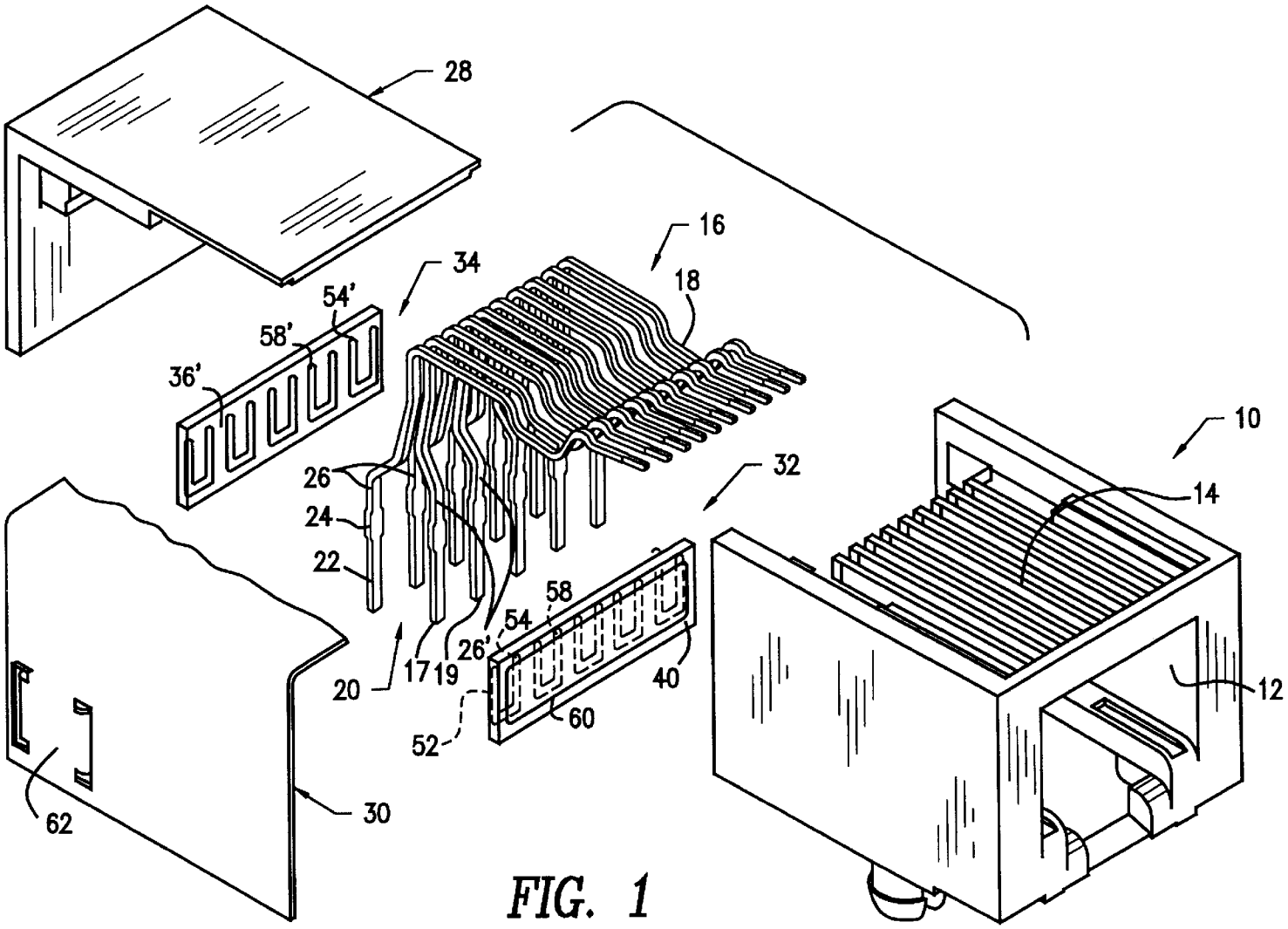
FIG. 1 is an exploded, perspective view illustrating a first preferred embodiment of the present invention.

Referring now to the drawings, wherein like reference numerals represent identical or corresponding parts throughout the several views, FIG. 1 illustrates an exploded, perspective view of a first preferred embodiment of the present invention.

Illustrated in FIG. 1 is a typical modular jack for mating a modular plug (not shown) to a printed circuit board (PCB; not shown). Reference numeral 10 indicates generally a dielectric housing of the modular jack. Housing 10 includes a plug-receiving opening 12 on the front side thereof which is sized to receive a mating modular plug (not shown). As described in any of my above-noted patents, the modular plug which mates with jack housing 10 normally includes a plurality of substantially planar, side-by-side contact terminals having an upper exposed edge which is adapted to mate with the spring contact portions of the jack, to be described in greater detail below.

Housing 10 is further provided on its top surface with a plurality of channels 14 which are adapted to receive a plurality of side-by-side electrical conductors indicated generally by reference numeral 16. There are ten such conductors illustrated in the embodiment of FIG. 1, but greater or fewer may be provided, as is well known.

Each of the conductors 16 include a spring contact portion 18 which is designed to engage a correspondingly-spaced contact terminal in the mating modular plug. The spring contact portions 18 are typically spaced 0.040" from each other.

The other end of the conductors 16 terminate in a PCB-matable end portion indicated generally by reference numeral 20. In the illustrated embodiment, the PCB-matable or end portions 20 are arranged in two rows in an alternating, staggered array to fit through a standard PCB grid spacing. This typically means that the two rows of PCB-matable portions are separated by 0.100", and adjacent conductors in the same row (e.g., conductors 17 and 19) are also separated by 0.100". For ease of reference throughout this specification, the end portions 20 of the conductors which include conductors 17 and 19 will be referred to as the front row, while the other row of end portions will be referred to as the rear row.

As illustrated in FIG. 1, the PCB-matable end portions 20 comprise solder tail portions 22 and tabs 24 for positioning the conductors 16 in slots (not shown) located in the rear of housing 10.

However, it should be understood that alternate arrangements for end portions 20 are possible, including various well known surface mount tail arrangements.

Positioned above tabs 24 are intermediate portions 26 of conductors 16. In the illustrated embodiment, five intermediate portions 26 are shown in the rear row of the end portions 20 of conductors 16, while five intermediate portions 26' are illustrated in the front row of end portions 20 of conductors 16. It may be appreciated that intermediate portions 26 and 26' are also arranged in an alternating, staggered array.

The modular jack housing 10 preferably also includes a cap 28 that covers conductors 16, and may also include a metal shield 30 for enclosing housing 10, for a purpose to be described in greater detail hereinafter.

In accordance with the present invention, there is provided a first capacitor module indicated generally by reference numeral 32 and a second capacitor module which is indicated generally by reference numeral 34. Modules 32 and 34 are substantially identical to each other and are aligned in parallel but on opposite sides of intermediate portions 26 and 26' of conductors 16. More particularly, the first capacitor module 32 faces and makes contact with intermediate portions 26' in the front row of conductors, while the second capacitor module 34 faces and makes contact with the intermediate portions 26 in the rear row of conductors.

Figure 2:
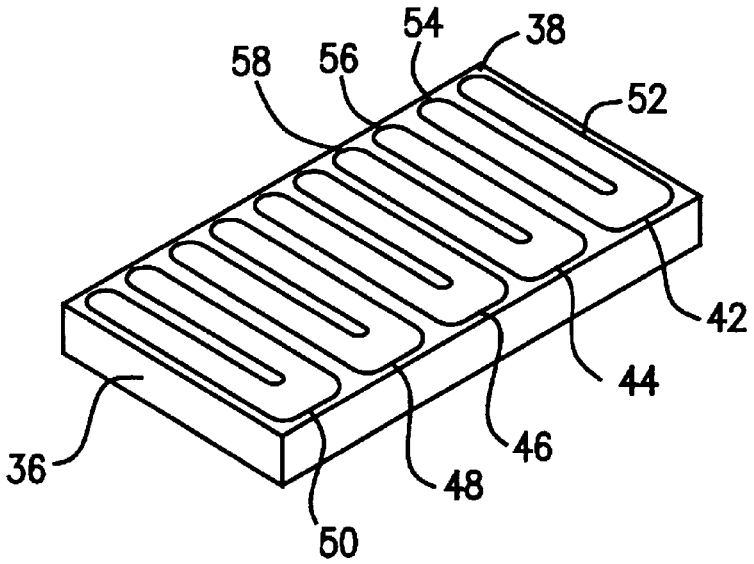
FIG. 2 is a perspective, enlarged view illustrating one element of the first preferred embodiment of FIG. 1.

FIG. 2 illustrates an enlarged view of module 32 which is seen to comprise a substrate 36 having a front side 38 and a back side 40 (not shown in FIG. 2). On front side 38 are etched or otherwise formed a plurality of (in this case five) U-shaped capacitor traces 42, 44, 46, 48 and 50. Each U-shaped trace, e.g. trace 42, includes one leg 52 which can be denominated the capacitor portion and another leg 54 which can be denominated the copper trace portion. Copper trace portion 54 is adapted to be connected to the intermediate portion 26' of conductor 16. It will be understood, however, that both legs 52 and 54 serve to define the capacitor. In a similar manner, trace 44 includes a capacitor portion 56 and a copper trace portion 58, while the same pattern holds for U-shaped traces 46, 48 and 50.

As shown better in FIG. 1, on the back side 40 of module 32 is formed a large capacitor pad 60 which is connected to ground by means of shield 30 and its integrally formed ground connections 62 so that any charge induced on the relatively large plate or pad 60 is provided with a path to ground. Connections 62 may be either soldered or crimped to pad 60.

As seen in FIG. 1, copper trace portions 54 and 58 are aligned with the first two intermediate portions 26' of end portions 17 and 19 in the front row of contacts so as to be matable therewith. In a similar manner, copper trace portions 54' and 58' on the front face of the second substrate 36' are aligned with the intermediate portions 26 on the rear row of the end portions of conductors 16. Thus, each capacitor on module 32 connects to every other conductor 16, while those conductors not connected to the capacitors on substrate 32 are connected to the five capacitors on substrate 34. In this manner, greater surface area is available on each of the substrates 32 and 34 for providing the desired capacitances. Use of every other contact in this manner also eases the manufacturing tolerances required.

In this manner, there is provided a capacitor in series with each of the conductors 16. Thus, the signal on each conductor 16 will be filtered through its respective capacitor. The capacitance of each capacitor will be selected to filter out the noise.

The electrical connection of the capacitors to the intermediate portions of the conductors may be achieved by using either reflow solder techniques, by melting a fillet of solder previously placed on the conductor's intermediate portion, by surface contact to a conductive ink, or by other means well known in the art.

Regarding the substrate 36, it is desirable to choose a substrate that has a particular, desired dielectric constant. The capacitance of each capacitor pad will depend upon the dielectric constant of the substrate, the thickness of the substrate, and the surface area of the capacitor ground plate and the pads. Also, the material of the substrate may have to withstand the high temperature of reflow solder operations. The typical preferred materials for the substrate 36 include: polyphenylenesulfide (PPS); polyselfone (PS); liquid crystal polymers; polyketone; or PCT polyester. The preferred thickness of the substrate range between 0.015" and 0.035". The size of the capacitor pads are selected to achieve capacitances ranging between 100 and 1,200 picofarads for each conductor.

It is preferred to use polymer substrates for the capacitor modules since they have the ability to flex without stress failure, whereas less desirable fiberglass boards are rigid. Flexibility may be important in enabling the board to accommodate slight differences in dimension to more easily engage the intermediate portions of the conductors. Thus, a substrate with a slight 'give' may be better able to achieve desired connection between the capacitor pad and the conductor.

Figure 3:
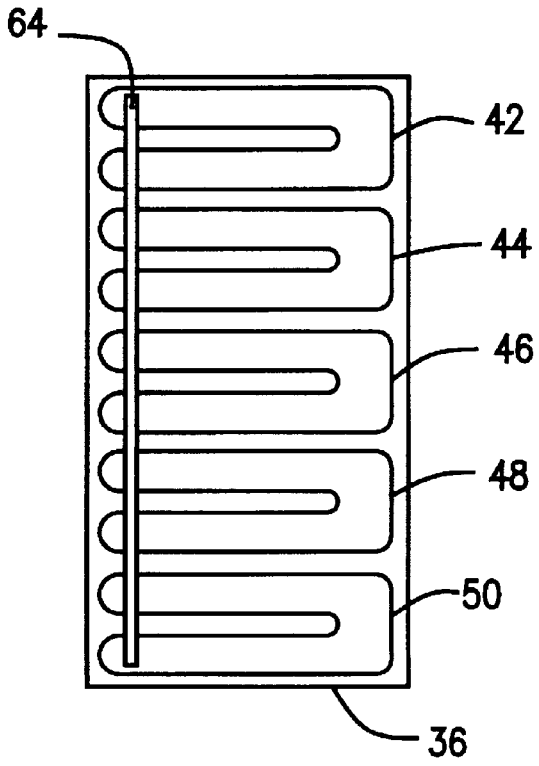
FIG. 3 is a top view of an alternate element for the embodiment of FIG. 1.

As seen in FIG. 3, a ferrite bar 64 may be bridged across all capacitors 42 through 50 on substrate 36 to provide some additional filtering. The ferrite bar aids in dissipating some of the higher frequencies.

Figure 4:
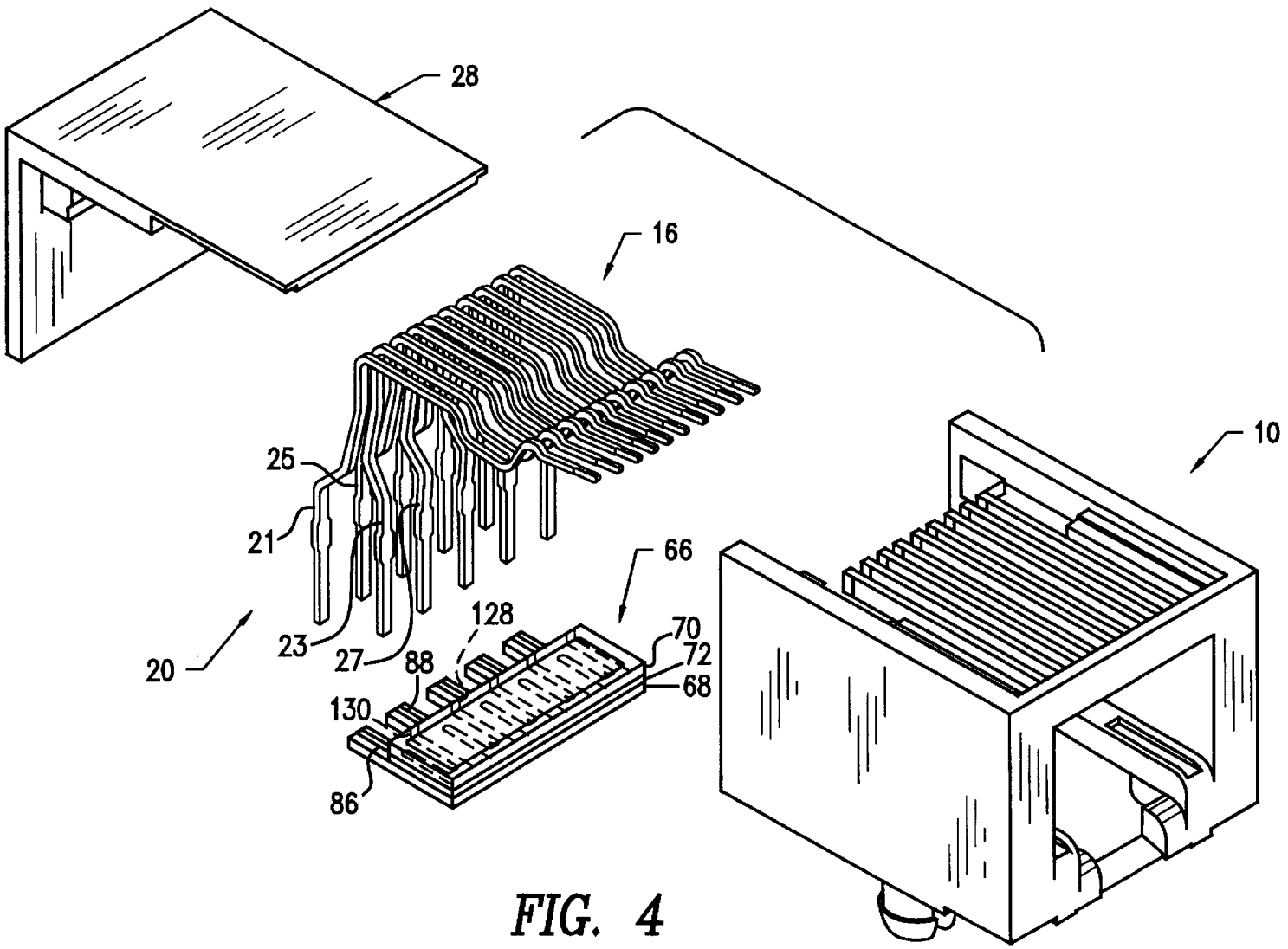
FIG. 4 is an exploded, perspective view illustrating a second embodiment of the present invention.

Referring now to FIG. 4, there is illustrated an alternate embodiment of the present invention which differs from the first embodiment in the provision of a single capacitor module 66 located entirely on one side of the intermediate portions of conductors 16. Capacitor module 66 includes all ten capacitors in one module.

Figure 5:
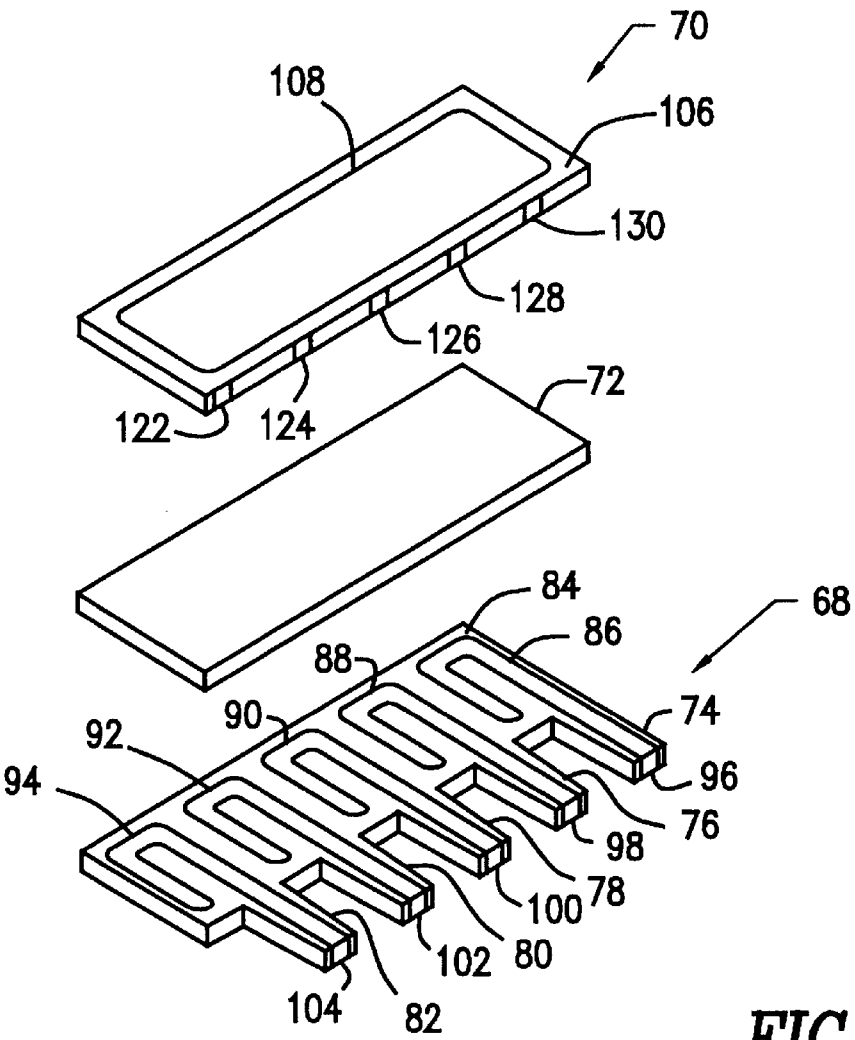
FIG. 5 is an exploded, perspective view illustrating one of the elements of the second embodiment of FIG. 4.

FIG. 5 illustrates module 66 in an exploded view which is seen to include a first capacitor substrate 68, a second capacitor substrate 70, and a third or insulating substrate 72 placed between substrates 68 and 70 to electrically insulate same.

On the first substrate 68 are positioned five fingers 74, 76, 78, 80 and 82 on the top surface 84 on which are deposited five capacitor traces 86, 88, 90, 92 and 94.

Note that each trace 86–94 includes a roll-over portion 96, 98, 100, 102 and 104 which extend over the outside vertical edge of respective fingers 74–82. On the reverse side of substrate 68 is positioned a large pad which serves as a ground plane (not shown).

Figure 6:
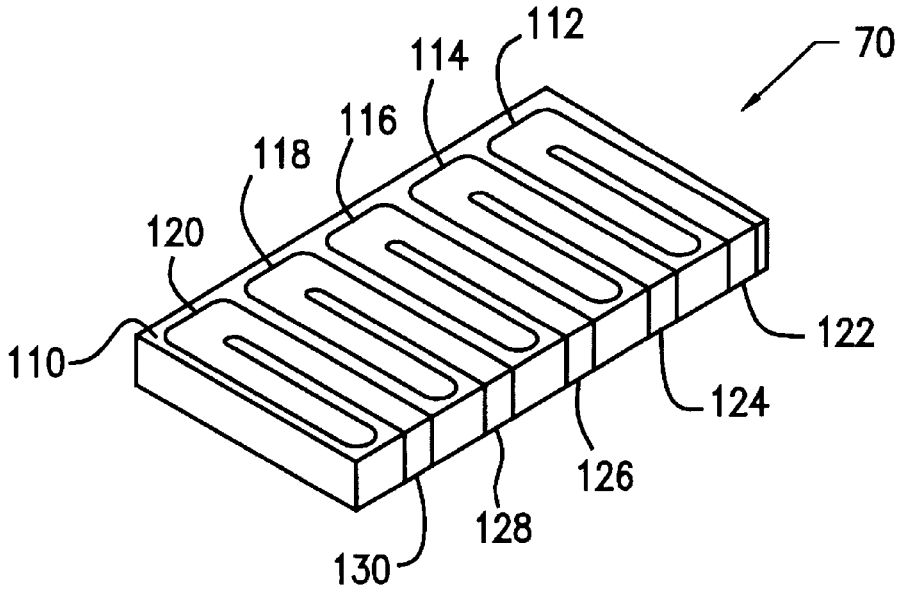
FIG. 6 is a perspective view showing in greater detail one of the elements illustrated in FIG. 5.

The second substrate 70 has a bottom side 106 on which is positioned a large pad 108 that serves as a ground plane. The top side 110 of substrate 70 is seen better in FIG. 6 and includes five capacitor traces 112, 114, 116, 118 and 120. Each of the five capacitor traces has a roll-over portion 122, 124, 126, 128 and 130 on its front face.

Referring back to FIG. 5, it is seen that fingers 74–82 fit between the positions of the roll-over portions 122–130, for reasons which will become clear hereinafter.

Referring back to FIG. 4, the first two intermediate portions in the front row of end portions 20 have been labeled with reference numerals 23 and 27, while the first two intermediate portions in the rear row have been labeled with references numerals 21 and 25.

Figure 7:
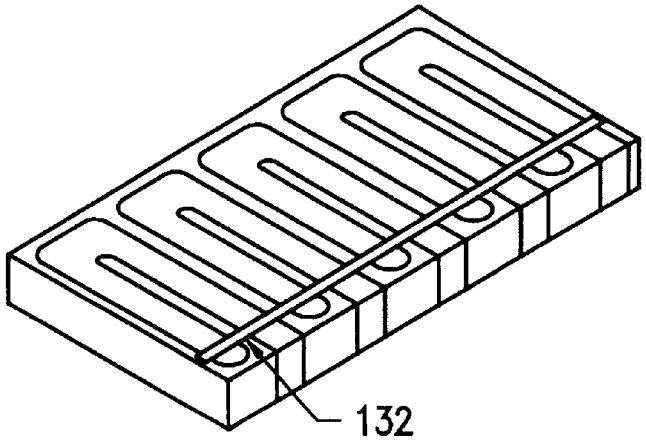
FIG. 7 is a perspective view illustrating an alternate element to the one illustrated in FIG. 6.

It may be appreciated from the foregoing that when assembled, roll-over portion 96 of trace 86 on finger 74 electrically connects to intermediate portion 21. Similarly, rollover portion 130 of trace 120 mates with intermediate portion 23; roll-over portion 98 (not shown in FIG. 4) of trace 88 mates with intermediate portion 25; and roll-over portion 128 of trace 118 mates with intermediate portion 27. The connections just described with respect to the first four capacitors in capacitor module 66 hold for the remaining six capacitors in a similar manner. As before, the electrical connection may be by any of the previously described techniques. Substrate 70 may also be provided with a ferrite bar 132 as illustrated in FIG. 7 to provide additional filtering, if desired.

Figure 8:
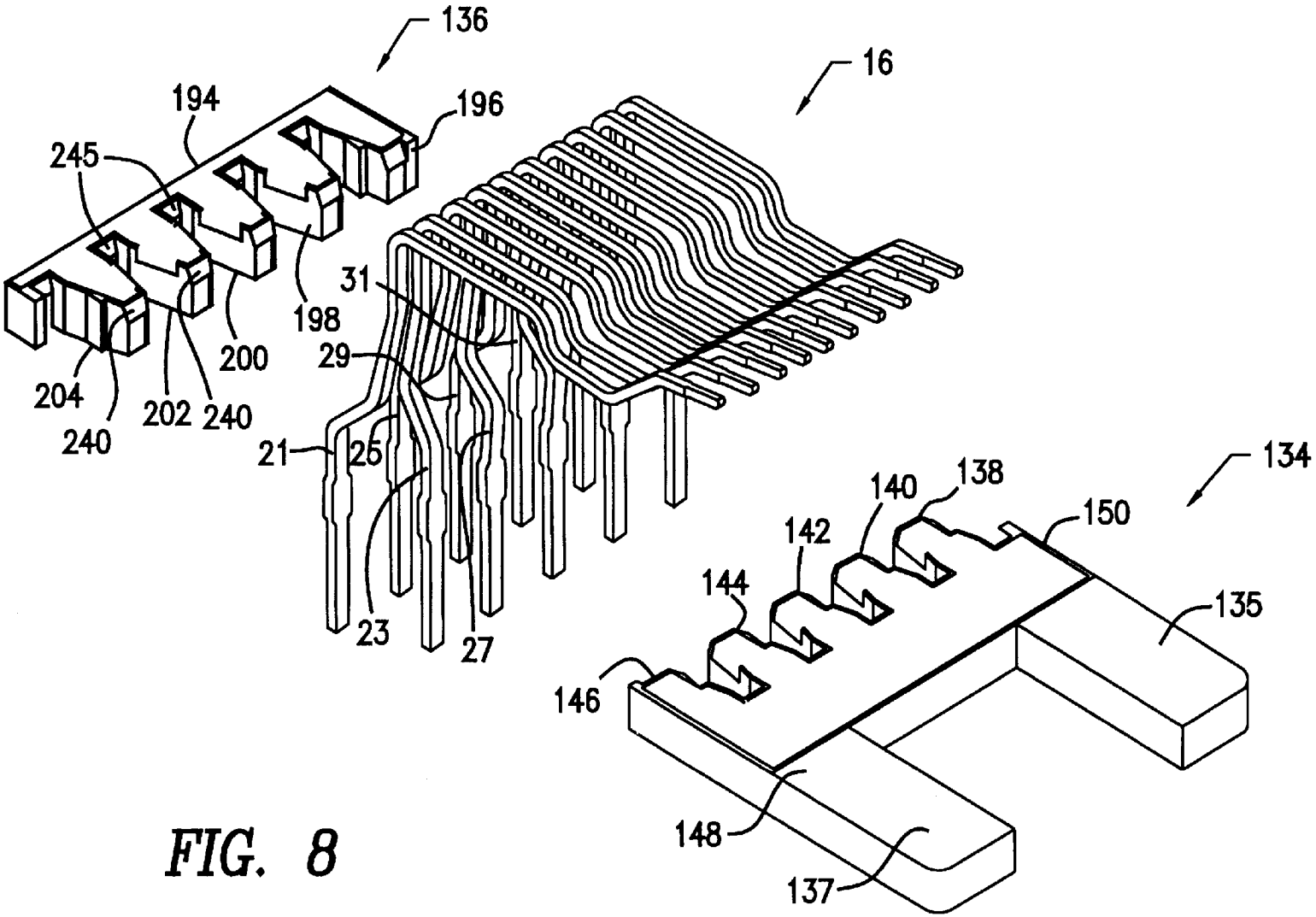
FIG. 8 is an exploded, perspective view illustrating a third preferred embodiment of the present invention.

Referring now to FIG. 8, a third preferred embodiment of the present invention is illustrated, but, for the sake of simplicity, without the housing, cap or shield members illustrated in the earlier embodiments. In addition to conductors 16, FIG. 8 illustrates a first capacitor module 134 and a second capacitor module 136. It is noted that capacitor modules 134 and 136, unlike the first embodiment, are not identical to one another, but are complimentary in the sense that in use they fit together, in a manner that will be described in greater detail hereinafter.

The first capacitor module 134 is provided with a pair of wings 135 and 137 that fit in keyways in the connector housing (not shown) for alignment and installation purposes. The first module 134 further includes a plurality of fingers 138, 140, 142, 144 and 146 extending in the opposite direction from wings 135 and 137. On the top surface of fingers 138–146 is positioned a large metallic pad 150 that serves as a ground plane 150.

Figure 9:
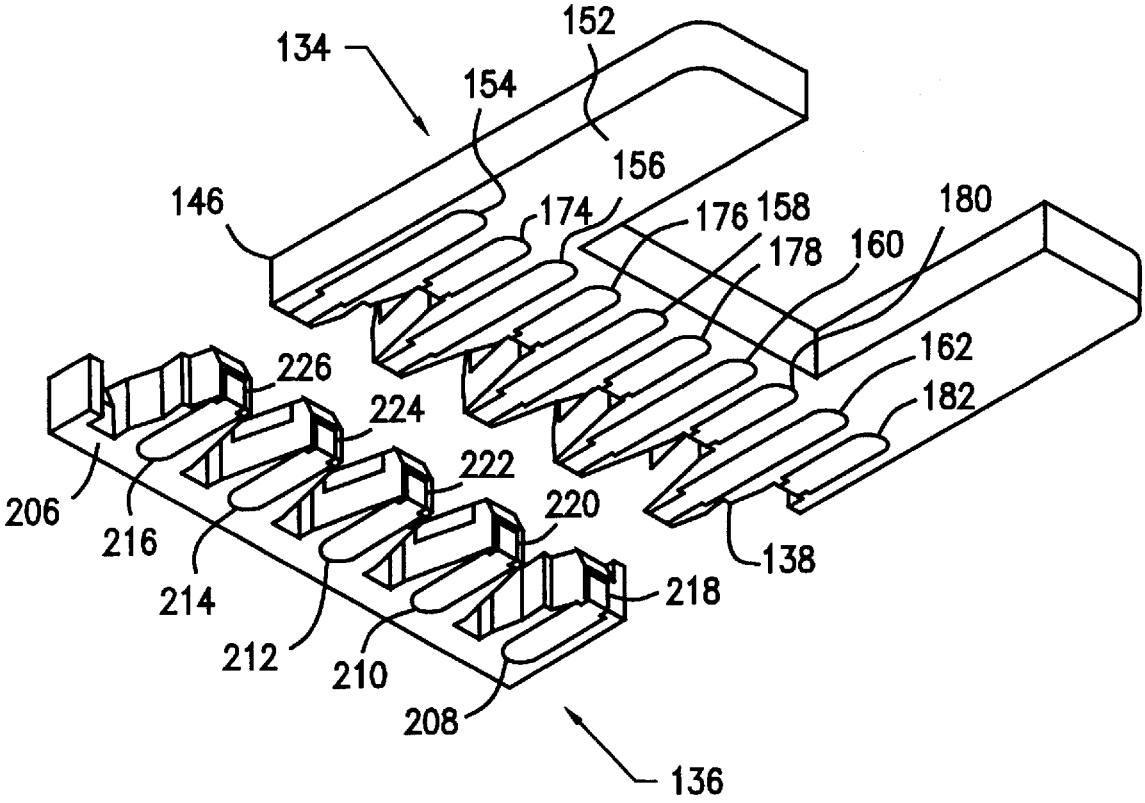
FIG. 9 is a perspective view illustrating the underside of certain components of the third embodiment of FIG. 8.

Referring now to FIG. 9, first capacitor module 134 includes a bottom surface 152. On each finger 138–146 of bottom surface 152 is positioned a capacitive pad 154, 156, 158, 160 and 162. Each of the capacitive pads 154–162 include a roll-over portion 164, 166, 168, 170 and 172 (see FIG. 10) for contacting the intermediate portions of alternating conductors, as will be described in greater detail hereinafter.

Referring back to FIG. 9, positioned between capacitor pads 154–162 are smaller capacitor pads 174, 176, 178, 180 and 182 each of which has a roll-over portion 184, 186, 188, 190 and 192, respectively (see FIG. 10) for contacting the intermediate portion of certain conductors.

Referring back to FIG. 8, the second capacitor module 136 includes a ground plane 194 formed on the top surface thereof and a plurality of fingers 196, 198, 200, 202 and 204 extending forwardly therefrom.

As may be seen in FIG. 9, on the bottom surface 206 of fingers 196–204 are deposited capacitor pads 208, 210, 212, 214 and 216 each of which has a roll-over portion 218, 220, 222, 224 and 226.

Roll-over portions 218–226, it may be appreciated, are aligned opposite to rollover portions 184–194 of capacitor pads 174–182 on first substrate 134.

Figure 11:
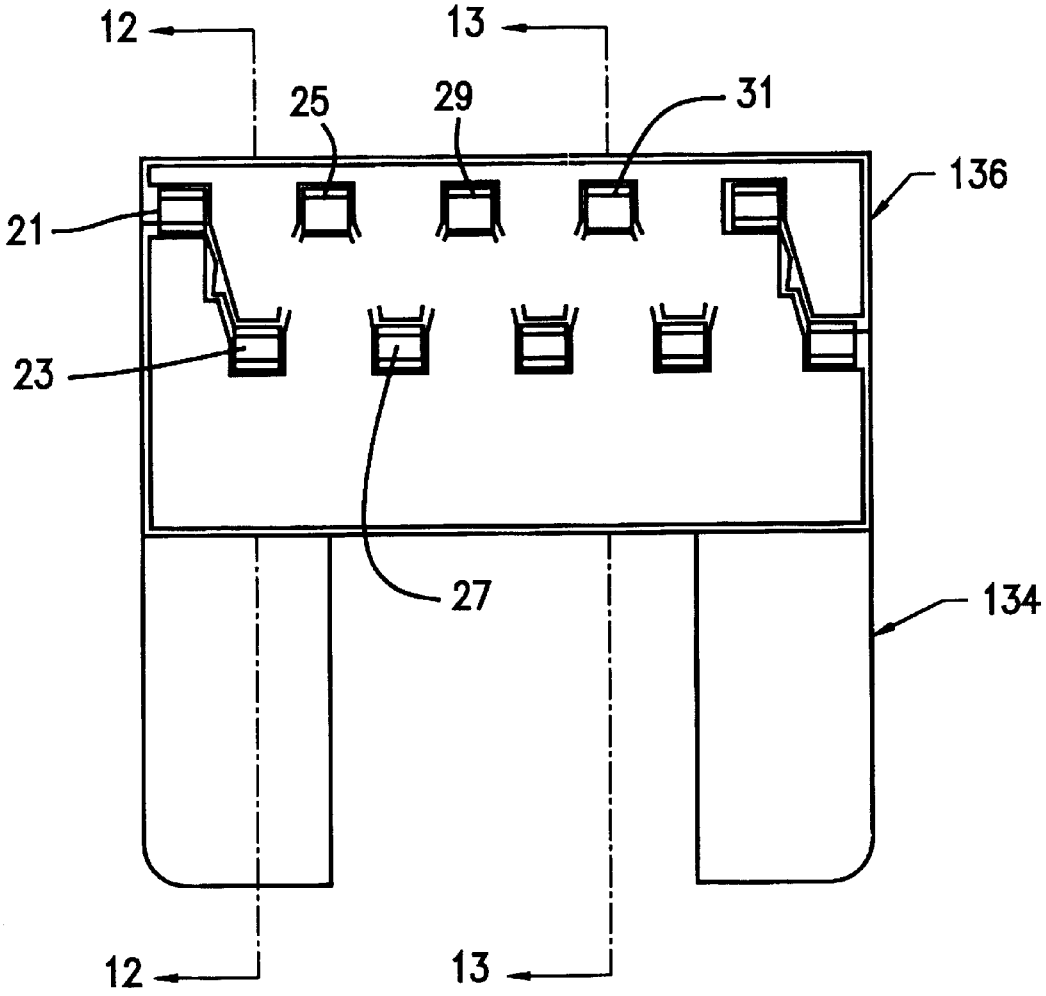
FIG. 11 is an illustration of the filter modules of the embodiment of FIG. 8 as they appear when fully installed.

FIG. 11 illustrates the capacitor module 134 in an assembled condition with the second capacitor module 136 and the intermediate portions of the conductors 16 positioned therebetween.

Figure 12:
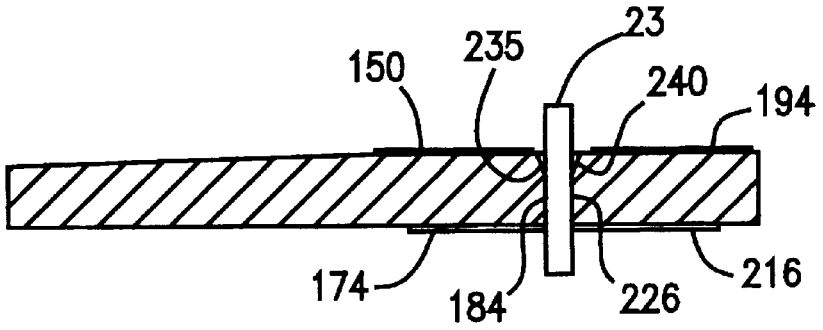
FIG. 12 is a sectional view of the installation of FIG. 11 taken along line 12—12 thereof.
Figure 14:
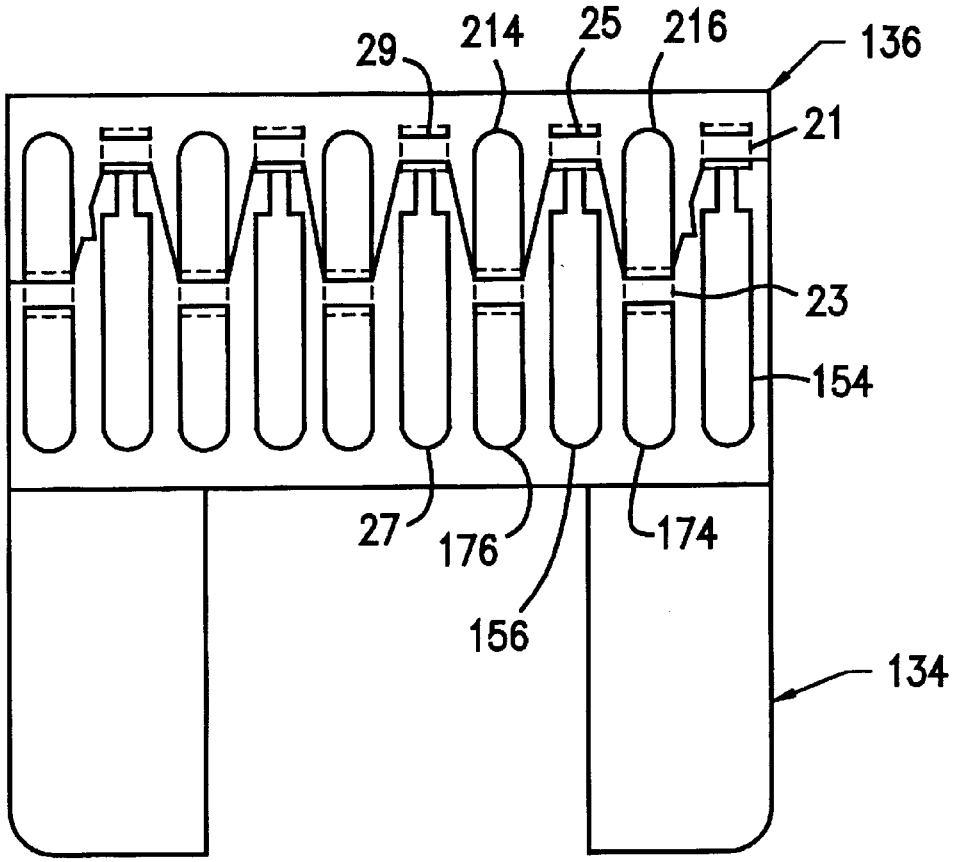
FIG. 14 illustrates the capacitor module including the intermediate portions of the staggered array of conductors.

It may be appreciated from FIG. 14 that capacitor pad 154 is of sufficient size to serve as the capacitance for the conductor that includes intermediate portion 21. However, due to the alternating, staggered array of conductors 16, under some circumstances there may not be enough room on the bottom surface of the first module 134 to provide sufficient surface area for the desired size capacitor pad for the conductor having intermediate portion 23. Thus, the capacitance for intermediate portion 23 is provided by two pads, i.e., capacitor pad 174 on first module 134 and pad 216 on second module 136. The fact that both pads 174 and 216 are connected to intermediate portion 23 is also illustrated in FIG. 12.

In a similar fashion, the capacitive pads for the rear row of contacts 21, 25, 29, 31, etc., may be provided by the single capacitive pads on the first module 134, such as capacitive pads 156, 158, etc. The capacitances for those conductors in the front row of contacts are provided by one pad on module 134 and another pad on module 136 (e.g. pads 176 and 214 for intermediate portion 27). In this manner, sufficient space may be provided by both modules 134 and 136 to achieve the desired capacitance.

Figure 10:
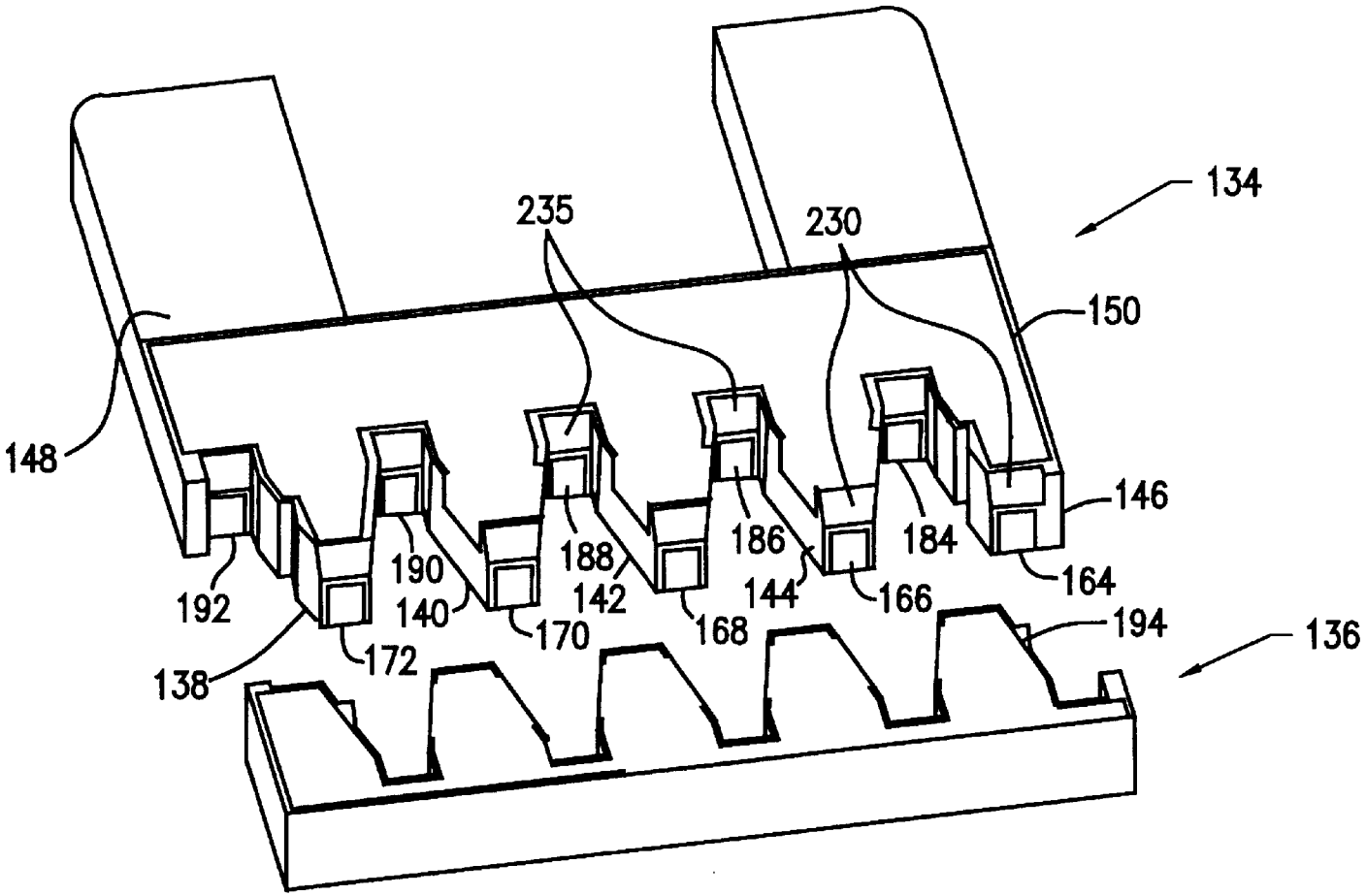
FIG. 10 is another perspective view of the filter modules of the embodiment of FIG. 8.

Care must be taken not to unintentionally ground the intermediate portions of conductors 16. To this end, as seen in FIG. 10, a beveled edge 230 is provided adjacent each finger tip on first module 134 adjacent the ground plane and the point of contact of each intermediate portion of the conductor. Further, as also seen in FIG. 10, a beveled edge 235 is provided between adjacent finger tips.

Similarly, notches or beveled edges 240 (see FIG. 8) are formed on the fingers of the second module 136, as are beveled edges 245 between adjacent finger tips.

Figure 13:
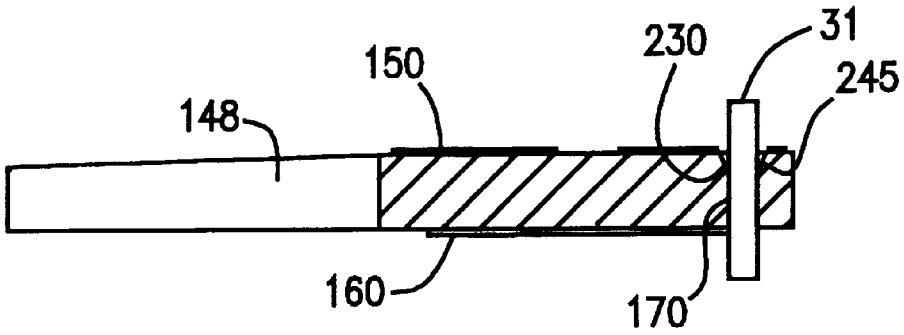
FIG. 13 is a sectional view of the installation of FIG. 11 taken along line 13—13 thereof.

As may be viewed in FIGS. 12 and 13, these notches or beveled edges 230, 235, 240 and 245 provide clearances to prevent the unintentional grounding of the intermediate portions 23 and 31 of conductors 16.

It may appreciated that I have provided a filtered modular jack which both provides the desired capacitance and still meets the 1,000 volt dielectric withstand requirement imposed by the FCC. The split board capacitance feature allows utilization of vacant space next to a single conductor as the capacitive pad for the adjacent conductor. In other words, the space between conductors is utilized as the capacitive pad for the neighbor. This allows a great increase in the size of the pads, which in turn enables a greater variation in the desired capacitance.

It should further be understood that the present invention may be utilized in any modular jack wherein the PCB mateable portions are arranged in an alternating, staggered array. Obviously, numerous modifications and variations of the present invention are possible in light of the above teachings. It should therefore be understood that within the scope of the appended claims, the invention may be practiced otherwise than as specifically described herein.

I claim as my invention:

1. A modular jack for electrically connecting a modular plug to printed circuit board, said jack being of the type having a dielectric housing which are positioned a plurality of side-by-side conductors, each of said conductors including a spring contact portion adapted to engage a contact of a mating plug, a solder tail to be connected to said printed circuit board, and an intermediate portion located between said spring contact portion and said solder tail, said conductors arranged in an alternating, staggered array, said modular jack further comprising:

a first capacitor module having a first set of capacitors thereon in electrical contact with each of a first set of said intermediate portions of said conductors; and a second capacitor module having a second set of capacitors in electrical contact with each of a second set of said intermediate portions of said conductors.

2. A modular jack as set forth in claim 1, wherein said first and second capacitor modules comprise first and second substantially planar substrates, respectively.

3. A modular jack as set forth in claim 2, wherein said first and second substantially planar substrates are positioned in said housing substantially parallel with one another.

4. A modular jack as set forth in claim 3, wherein said first and second substrates are located on opposite sides of said intermediate portions of said conductors.

5. A modular jack as set forth in claim 3, wherein said first and second substrates are located on the same side of said intermediate portions of said conductors.

6. A modular jack as set forth in claim 2, wherein said first and second substrates are positioned in said housing substantially co-planar with one another.

7. A modular jack as set forth in claim 6, wherein said first and second substrates are located on opposite sides of said intermediate portions of said conductors.

8. A modular jack as set forth in claim 2, wherein each of said first and second substrates comprises a front side, and a back side which is parallel with and spaced from said front side, said front side having a plurality of conductive traces formed thereon, said back side having a ground plane formed thereon.

9. A modular jack as set forth in claim 8, wherein said conductive traces each comprise a capacitor, and is substantially U-shaped.

10. A modular jack as set forth in claim 9, wherein said U-shaped capacitors have two legs, one of which is electrically connected to an intermediate portion of one of said conductors of said modular jack.

11. A modular jack as set forth in claim 10, wherein said first and second substrates are located on opposite sides of said intermediate portions of said conductors.

12. A modular jack as set forth in claim 11, wherein said front sides of said first and second substrates are closer to each other than their respective back sides.

13. A modular jack as set forth in claim 12, wherein said substrates further include ferrite rod means connected to said conductive traces.

14. A modular jack as set forth in claim 10, wherein said first substrate further includes a plurality of fingers projecting from one edge thereof.

15. A modular jack as set forth in claim 14, wherein one of said legs of each of said U-shaped capacitors on said front side of said first substrate extends along said fingers thereof and includes a rollover portion extending over the edge of the respective finger.

16. A modular jack as set forth in claim 15, wherein one of said two legs on said front side of said second substrate includes a roll-over portion extending over the edge of said second substrate.

17. A modular jack as set forth in claim 16, wherein said first and second substrates are located on the same sides of said intermediate portions of said conductors.

18. A modular jack as set forth in claim 17, further comprising a third substrate located between said first and second substrates for insulating each from the other.

19. A modular jack as set forth in claim 18, wherein said front sides of said first and second substrates are closer to each other than their respective back sides.

20. A modular jack as set forth in claim 19, wherein said substrates further include ferrite rod means connected to said conductive traces.

21. A modular jack as set forth in claim 1, wherein said first and second capacitor modules comprise first and second complimentary substrates, respectively.

22. A modular jack as set forth in claim 21, wherein said first and second complimentary substrates are positioned on opposite sides of said intermediate portions of said conductors.

23. A modular jack as set forth in claim 22, wherein each of said first and second complimentary substrates comprises a front side, and a back side which is parallel with and spaced from said front side, said front side having a plurality of conductive traces formed thereon, said back side having a ground plane formed thereon.

24. A modular jack as set forth in claim 23, wherein said first and second complimentary substrates each include a plurality of fingers extending from one edge thereof, said fingers from said first and second complimentary substrates adapted to interfit with each other.

25. A modular jack as set forth in claim 24, wherein said intermediate portions of said conductors are positioned adjacent the tips of said fingers of said first and second complimentary substrates.

26. A modular jack as set forth in claim 25, wherein said front side of said first complimentary substrate includes a first set of conductive traces which extend along said fingers of said first complimentary substrate and which include first rollover portions that extend over the front face of said fingers.

27. A modular jack as set forth in claim 26, wherein said front side of said second complimentary substrate includes a second set of conductive traces which extend along said fingers of said second complimentary substrate and which include second roll-over portions that extend over the front face of said fingers.

28. A modular jack as set forth in claim 27, wherein said front side of said first complimentary substrate further includes a third set of conductive traces which extend parallel to and between said first set of conductive traces, said third set of traces including third rollover portions that extend over the edge of the spaces between said fingers of said first complimentary substrate.

29. A modular jack as set forth in claim 28, wherein said first set of conductive traces comprise said first set of capacitors.

30. A modular jack as set forth in claim 29, wherein said second and third set of conductive traces comprise said second set of capacitors.

31. A modular jack as set forth in claim 30, wherein said first rollover portions contact said first set of intermediate portions of said conductors, and said second and third rollover portions contact said second set of intermediate portions of said conductors.

32. A modular jack as set forth in claim 31, further comprising means for electrically connecting said ground planes on said back sides of said first and second complimentary substrates to each other.

* * * * *